US007779937B2

(12) United States Patent
Luce et al.

(10) Patent No.: US 7,779,937 B2
(45) Date of Patent: Aug. 24, 2010

(54) STEEL TOOTH BIT WITH SCOOPED TEETH PROFILE

(75) Inventors: David K. Luce, Splendora, TX (US); Robert J. Buske, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 30 days.

(21) Appl. No.: 12/176,825

(22) Filed: Jul. 21, 2008

(65) Prior Publication Data

US 2010/0012384 A1 Jan. 21, 2010

(51) Int. Cl.
*E21B 10/46* (2006.01)
*E21B 10/50* (2006.01)

(52) U.S. Cl. ..... 175/374; 175/375; 175/425; 76/108.2

(58) Field of Classification Search ..... 175/374, 175/375, 425; 76/108.2
See application file for complete search history.

(56) References Cited

U.S. PATENT DOCUMENTS

| | | | | |
|---|---|---|---|---|
| 5,152,194 | A * | 10/1992 | Keshavan et al. | 76/108.2 |
| 6,161,634 | A | 12/2000 | Minikus et al. | |
| 6,206,115 | B1 | 3/2001 | Overstreet et al. | |
| 6,360,832 | B1 | 3/2002 | Overstreet et al. | |
| 6,374,704 | B1 | 4/2002 | Scott et al. | |
| 6,530,441 | B1 | 3/2003 | Singh et al. | |
| 6,615,936 | B1 * | 9/2003 | Mourik et al. | 175/426 |
| 6,725,952 | B2 | 4/2004 | Singh | |
| 6,923,276 | B2 | 8/2005 | Overstreet et al. | |
| 6,948,403 | B2 | 9/2005 | Singh | |
| 2001/0027881 | A1 | 10/2001 | Steinke | |

* cited by examiner

*Primary Examiner*—Giovanna C Wright
(74) *Attorney, Agent, or Firm*—Bracewell & Giuliani LLP

(57) ABSTRACT

An earth-boring bit has at least one steel tooth with a scoop-shaped profile. The scoop-shaped profile is formed by milling and hardfacing a tooth to have at least one flank with a concave profile. Additionally, the tooth may contain one flank with a concave profile and another with a convex profile. The centerline axis of the tooth may be moved to alter the angle between the flanks and the centerline to vary the manner in which the tooth engages the formation.

11 Claims, 4 Drawing Sheets

STEEL TOOTH BIT WITH SCOOPED TEETH PROFILE

FIELD OF THE INVENTION

This invention relates to improvements to earth-boring tools, especially to steel-tooth bits that use hardfacing to enhance wear resistance.

BACKGROUND

The earliest rolling cutter earth-boring bits had teeth machined integrally from steel, conically shaped, earth disintegrating cutters. These bits, commonly known as "steel-tooth" or "mill-tooth" bits, are typically used for penetrating relatively soft geological formations of the earth. The strength and fracture-toughness of steel teeth permits the effective use of relatively long teeth, which enables the aggressive gouging and scraping action that is advantageous for rapid penetration of soft formations with low compressive strengths.

However, it is rare that geological formations consist entirely of soft material with low compressive strength. Often, there are streaks of hard, abrasive materials that a steel-tooth bit should penetrate economically without damage to the bit. Although steel teeth possess good strength, abrasion resistance is inadequate to permit continued rapid penetration of hard or abrasive streaks.

Consequently, it has been common in the art since at least the early 1930s to provide a layer of wear resistant metallurgical material called "hardfacing" over those portions of the teeth exposed to the severest wear. The hardfacing typically consists of extremely hard particles, such as sintered, cast or macrocrystalline tungsten carbide dispersed in a steel, cobalt or nickel alloy binder or matrix. Such hardfacing materials are applied by heating with a torch a tube of the particles that welds to the surface to be hardfaced a homogeneous dispersion of hard particles in the matrix. After hardfacing, the cone is preferably heat treated, which typically includes carburizing and quenching from a high temperature to harden the cone. The particles are much harder than the matrix but more brittle. After hardening, the matrix has a hardness preferably in the range from 53 to 68 Rockwell C (RC). The mixture of hard particles with a softer but tougher steel matrix is a synergistic combination that produces a good hardfacing. There have been a variety of different hardfacing materials and patterns, including special tooth configurations, to improve wear resistance or provide self sharpening.

FIG. 1 shows a prior art mill-tooth bit 11. Earth-boring bit 11 includes a bit body 13 having threads 15 at its upper extent for connecting bit 11 into a drill string (not shown). Each leg of bit 11 may be provided with a lubricant compensator 17. At least one nozzle 19 may be provided in bit body 13 for directing pressurized drilling fluid from within the drill string and bit 11 against the bottom of the bore hole.

Cones 21, 23, generally three (one of which is obscured from view in FIG. 1), are rotatably secured to respective legs of bit body 13. A plurality of inner row teeth 25 and outer row teeth 27 are arranged in generally circumferential rows on cones 21, 23, being integrally formed on the cones, usually by machining. Outer or heel row teeth 27 are located at the outer edges of each cone 21, 23 adjacent gage surfaces 29. Each bit leg has a shirttail portion 31 on its outer side adjacent gage surface 29 of cones 21, 23. Typically, hardfacing will be applied to inner row teeth 25, heel row teeth 27, gage surface 29 and also to shirttail 31.

FIGS. 2 and 3 illustrate a tooth 28 that typically would be in a heel row in place of heel row 27 in cone 21 of FIG. 1.

Tooth 28 is formed with a milling cutter which forms a root 43, inclined flanks 33, 35 and an elongated crest 37. An outer or gage end 39 is located at the outer side adjacent gage surface 29 (FIG. 1), and an inner end 41 is located opposite outer end 39. Hardfacing 45 is applied to the flanks 33, 35, and crest 37. Tooth 28 has a centerline 49 (FIG. 3) which is substantially symmetrical and bisects tooth 28. Centerline 49 extends through the axis of rotation of cone 21.

SUMMARY OF INVENTION

The earth-boring bit of this invention has at least one hardfaced steel tooth with a scoop-shaped profile. The scoop-shaped profile is formed by milling or hardfacing a tooth to have at least one flank with a concave profile. Additionally, the tooth may contain one flank with a concave profile and another with a convex profile. The centerline of the tooth may be moved to alter the angle between the flanks and the centerline to vary the manner in which the tooth engages the formation.

DETAILED DESCRIPTION OF THE INVENTION

Figure 1:
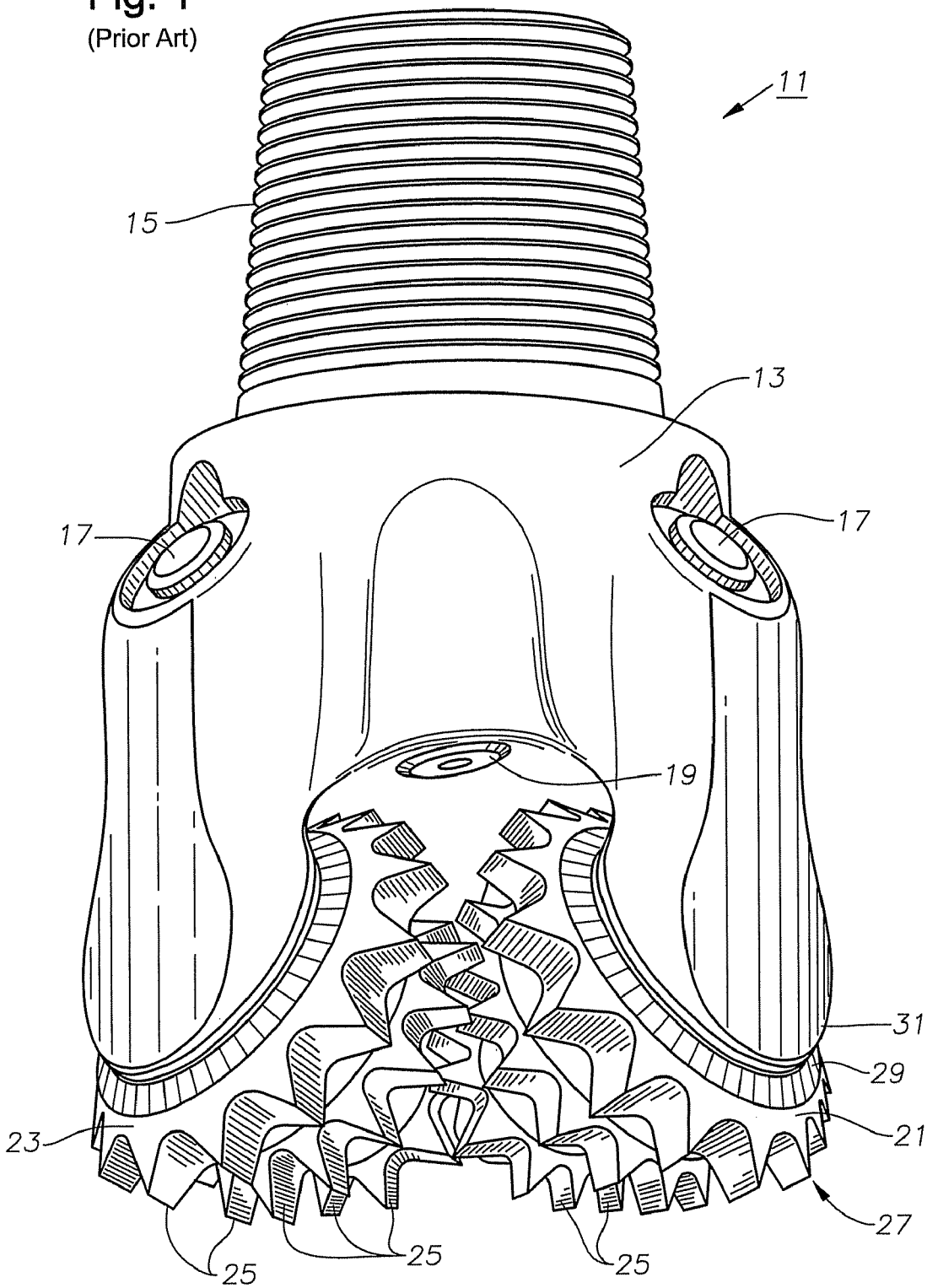
Fig. 1 (Prior Art)
FIG. 1 is a side elevation of a prior art earth-boring bit.
Figure 2:
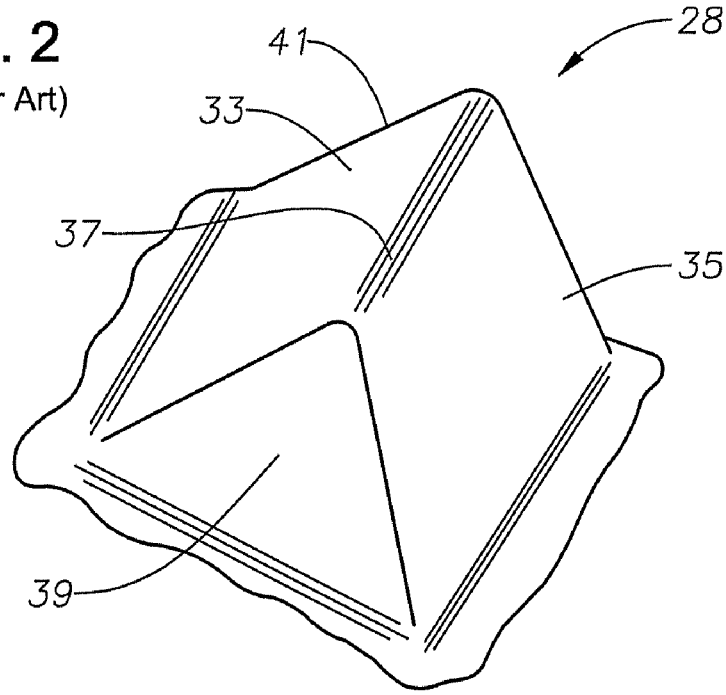
Fig. 2 (Prior Art)
FIG. 2 is a perspective view of one tooth of one of the cutters of the prior art bit of FIG. 1.
Figure 3:
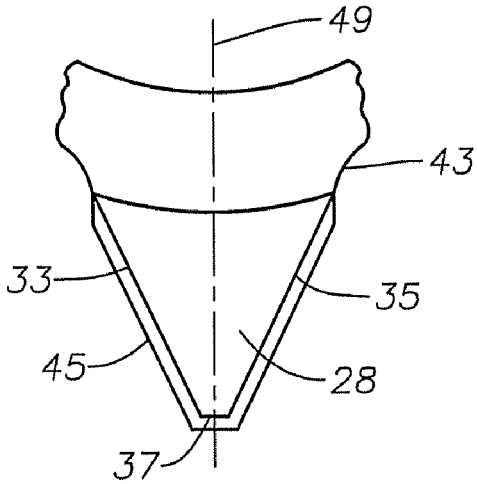
Fig. 3 (Prior Art)
FIG. 3 is a sectional view of the tooth of FIG. 2.
Figure 4:
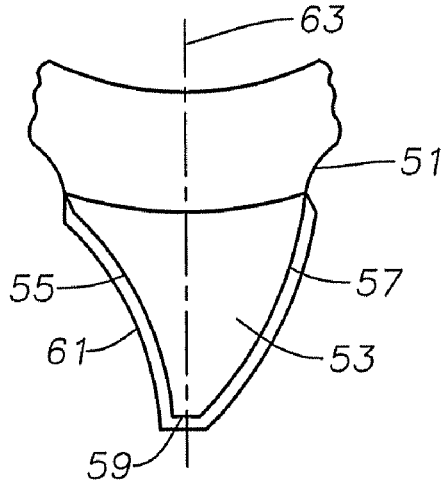
FIG. 4 is a sectional view of a hardfaced tooth constructed in accordance of this invention.

FIG. 4 illustrates a tooth 53 constructed in accordance of this invention. Tooth 53 is formed with a milling cutter (not shown) which forms a root 51, inclined flanks 55, 57 and a crest 59. Flank 55 is milled with a concave profile, and flank 57 is milled with a convex profile. The terms "concave" and "convex" are used broadly to mean inward and outward curved surfaces. Flanks 55, 57 are not portions of a sphere. Flanks 55, 57 incline and converge toward each other, joining at a crest 59. The result is a scoop-shaped tooth 53. Hardfacing 61 is preferably applied in an even thickness to flanks 55, 57, and crest 59.

In one embodiment, tooth 53 has a centerline 63 that bisects tooth 53, with flank 55 on one side and flank 57 on the other. Centerline 63 extends through the axis of rotation of the cone: centerline 63 would equally bisect flanks 55, 57 if they were flat. Of flanks 55, 57, one is a leading flank and the other a trailing flank, considering the direction of rotation of cone 21, 23. The leading flank faces into the direction of rotation. The leading flank may be concave and the trailing flank convex. Alternatively, the leading flank may be convex and the trailing flank concave. Because of the different configurations of flanks 55, 57, tooth 53 is not symmetrical about axis 63 when viewed in the sectional plane of FIG. 4. If viewed in a sectional plane perpendicular to that of FIG. 4, tooth 53 could appear symmetrical.

Figure 5:
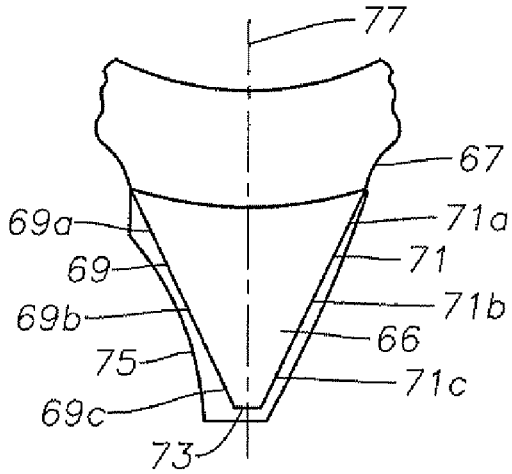
FIG. 5 is a sectional view similar to FIG. 4, but showing an alternate embodiment of the hardfaced tooth.

FIG. 5 illustrates an alternate embodiment tooth 66 constructed in accordance of this invention. Tooth 66 is formed with a milling cutter which forms a root 67, inclined flanks 69, 71 and a crest 73. Flanks 69, 71 incline and converge toward each other, joining at a crest 73. Flanks 69, 71 are flat and identical prior to the application of hardfacing. Hardfacing 75 is applied in varying thickness to flanks 69, 71, and crest 73. In the embodiment shown, the hardfacing 75 thickness varies on the concave flank 69 and convex flank 71 between the crest 73 and the root 67. More specifically, the hardfacing 75 thickness on the flank upper section 69*c* proximate the crest 73 and the flank lower section 69*a* proximate the root 67 is greater than the hardfacing 75 thickness proximate the flank middle section 69*b*. The hardfacing 75 thickness change between these three sections defines a semi-circular surface on the hardfacing 75 curving outward from the flank 69 at the upper and lower sections 69*a*, 69*c* to thereby form a concave surface. Hardfacing 75 is applied to flank 71 with a thickness at section 71*b* of flank 71 that is greater than that at sections 71*a*, 71*c*. The result of applying hardfacing 75 in this manner is a convex profile formed on flank 71. Combining a concave flank 69 and a convex flank 71 forms a scoop-shaped tooth 66.

Tooth 66 has a centerline 77 bisects tooth 66 and extends through the axis of rotation of the cone. Prior to hardfacing, flanks 69, 71 are symmetrical about centerline 77 in the plane shown in FIG. 5. Of flanks 69, 71, one is a leading flank and the other a trailing flank, considering the direction of rotation of cone 21, 23. The leading flank faces into the direction of cone 21, 23 rotation. The leading flank may be concave and the trailing flank convex. Alternatively, the leading flank may be convex and the trailing flank concave.

Figure 6:
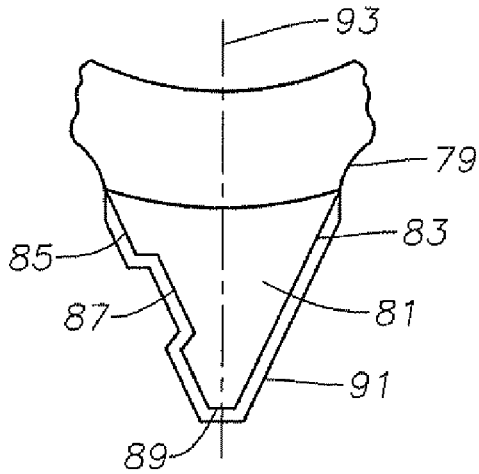
FIG. 6 is another sectional view similar to FIG. 4, but showing a second alternate embodiment of a tooth hardfaced in accordance with this invention.

FIG. 6 illustrates a second alternate embodiment tooth 81 constructed in accordance of this invention. Tooth 81 is formed with a milling cutter which forms a root 79, inclined flanks 83, 85 and a crest 89. Flanks 83, 85 incline and converge toward each other, joining at a crest 89. A recess 87 is milled into flank 85 at a location between root 79 and crest 89. In the embodiment illustrated, hardfacing 91 is applied in an even thickness to flanks 83, 85, recess 87, and crest 89. Recess 87 forms a concave like profile on flank 85. The result is a scoop-shaped tooth 81.

Tooth 81 has a centerline 93 which bisects tooth 81 equally prior to forming recess 87. Centerline 93 intersects the axis of rotation of the cone. After hardfacing, flanks 83, 85 are asymmetrical about centerline 93 in the plane shown in FIG. 6. Of flanks 83, 85, one is a leading flank and the other a trailing flank, considering the direction of rotation of cutters 21, 23. The leading flank faces into the direction of cone 21, 23 rotation. The leading flank may be milled with a recess to form a concave profile. Alternatively, the trailing flank may be milled with a recess to form a concave profile.

Figure 7:
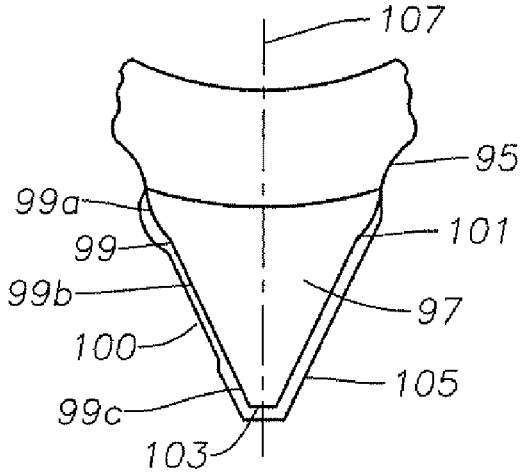
FIG. 7 is another sectional view similar to FIG. 4, but showing a third alternate embodiment of a tooth hardfaced in accordance with this invention.

FIG. 7 illustrates a third alternate embodiment tooth 97 constructed in accordance of this invention. Tooth 97 is formed with a milling cutter which forms a root 95, inclined flanks 99, 101 and a crest 103. Flanks 99, 101 incline and converge toward each other, joining at a crest 103. Flanks 99, 101 are flat and identical prior to the application of hardfacing 105. Hardfacing 105 is applied in varying thickness to flank 99. More specifically, the hardfacing 105 thickness on the flank upper section 99*c* proximate the crest 103 and the flank lower section 99*a* proximate the root 95 is greater than the hardfacing 105 thickness proximate the flank middle section 99*b*. The hardfacing 105 thickness change between these three sections defines a recess 100 on the hardfacing 105 curving inward toward the flank 69 at the middle section 99*b* to thereby form a concave like surface. Hardfacing 75 is applied evenly to crest 103 and flank 101. The result is a scoop-shaped tooth 95.

Tooth 95 has a centerline 107 which bisects tooth 95 prior to applying hardfacing. After hardfacing, flanks 99, 101 are asymmetrical about centerline 107 in the plane shown in FIG. 7. Of flanks 99, 101, one is a leading flank and the other a trailing flank, considering the direction of rotation of cutters 21, 23. The leading flank faces into the direction of cutter 21, 23 rotation. The leading flank may be hardfaced with a recess to form a concave profile. Alternatively, the trailing flank may be hardfaced with a recess to form a concave profile.

Figure 9:
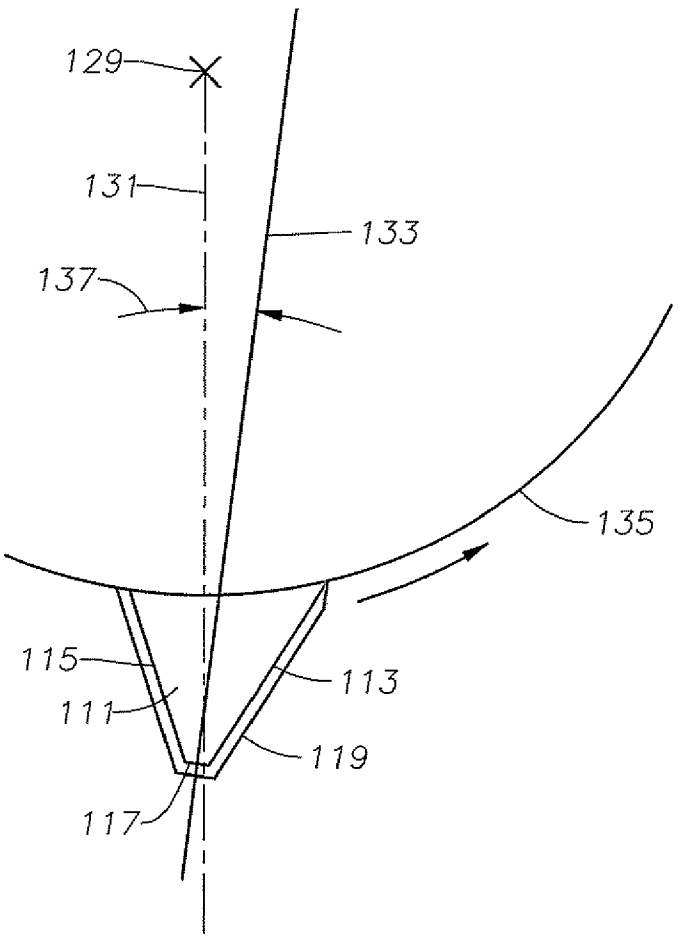
FIG. 9 is another sectional view similar to FIG. 4, but showing a fifth alternate embodiment of a tooth hardfaced in accordance with this invention.
Figure 8:
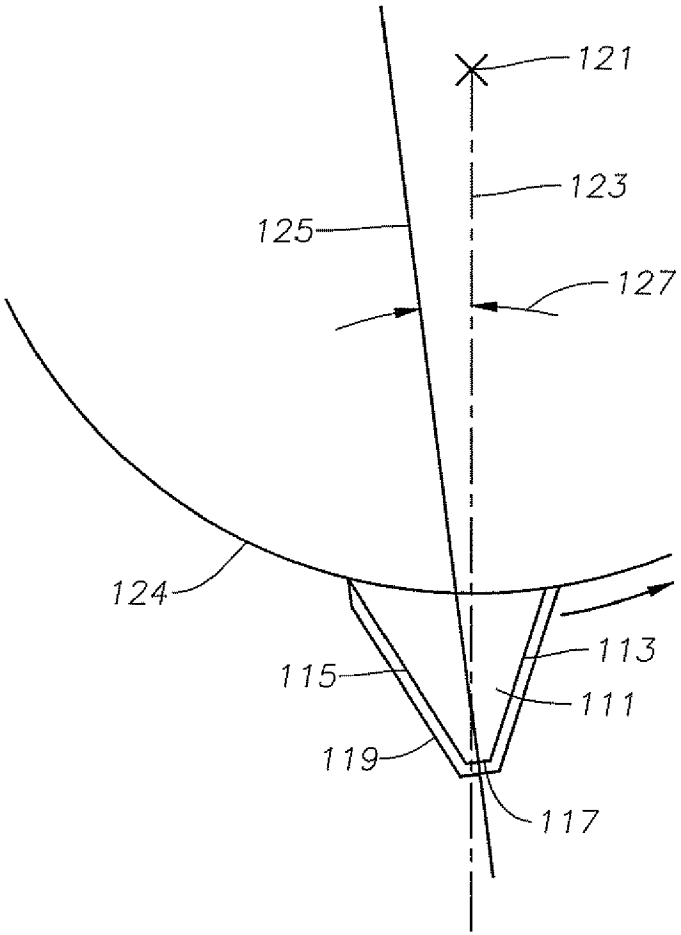
FIG. 8 is another sectional view similar to FIG. 4, but showing a fourth alternate embodiment of a tooth hardfaced in accordance with this invention.

FIGS. 8 and 9 illustrate another alternate embodiment tooth 111 constructed in accordance of this invention. A milling cutter forms a root (not shown), inclined flanks 113, 115 and a crest 117. Flanks 113, 115 incline and converge toward each other, joining at a crest 117. Hardfacing 119 is applied in an even thickness to flanks 113, 115, and crest 117.

Referring to FIG. 8, radial line 123 extends from crest 117 through the axis of rotation 121 of the cone 124. Cone 124 direction of rotation is indicated by the arrow. Centerline 125 is substantially equidistant between flanks 113, 115, assuming flanks 113, 115 were straight, flat surfaces. Centerline 125 is not normal to the cylindrical surface of the cone 124 and does not intersect axis 121. Tooth 111 tilts to the left. Centerline 125 lags radial line 123. Centerline 125 and radial line 123 intersect each other at crest 117 at an acute angle 127.

Referring to FIG. 9, radial line 131 extends from crest 117 through the axis of rotation 129 of cone 135. Cone 135 direction of rotation is indicated by the arrow. Centerline 133 is substantially equidistant between flanks 113, 115, assuming flanks 113, 115 were straight, flat surfaces. Centerline 133 is not normal to the cylindrical surface of the cone 135 and does not intersect axis 129. Tooth 111 tilts to the right. Centerline 133 leads radial line 131. Centerline 133 and radial line 131 intersect each other at crest 117 an acute angle 137.

The various orientations of a bit tooth may be varied by changing the lead or lag of the centerline relative to the radial line, and the angle at which to two lines intersect. Various orientations may have some structural advantages per bending moments, etc. The orientation of the tooth may be varied with all the embodiments of the present invention, and is not limited to tooth 111.

The invention has significant advantages. By forming a steel tooth with a scoop-shape with convex and concave flanks, the localized interaction between the tooth structure and the formation are altered, leading to higher rate of penetration or longer production life. By varying the centerline axis of a steel tooth, the local force on the formation may be increased.

While the invention has been shown in only a few of its forms, it should be apparent to those skilled in the art that it is not so limited, but is susceptible to various changes without departing from the scope of the invention. For example, although shown only on a heel row tooth, the milling and hardfacing in accordance with this invention could also be applied to inner row teeth and various tooth geometries.

The invention claimed is:

1. An earth-boring bit comprising:

a bit body;

at least one roller cone rotatably mounted on the bit body;

a plurality of milled teeth at selected locations on the cone, wherein each tooth has leading and trailing underlying flanks converging from a root to define a crest; and a layer of substantially uniform hardfacing on each of the underlying flanks, defining hardfaced flanks; and wherein one of the underlying flanks of each tooth is generally concave from root to crest and the other generally convex from root to crest.

2. The earth-boring bit of claim 1 further comprising a generally flat recess milled in the surface of at least one of the underlying flanks between the root and the crest.

3. The earth boring bit of claim 1 wherein a centerline substantially bisecting each tooth between its flanks, and a radial line of the axis of rotation of the cone intersect at the crest at an angle.

4. The earth boring bit of claim 3 wherein the centerline lags the radial line with respect to a counterclockwise direction of rotation of the cone.

5. The earth boring bit of claim 3 wherein the centerline leads the radial line with respect to a counterclockwise direction of rotation of the cone.

6. An earth-boring bit comprising:

a bit body;

at least one roller cone rotatably mounted on the bit body;

a plurality of milled teeth at selected locations on the cone, wherein each tooth has leading and trailing underlying flanks converging from a root to define a crest; and a layer of hardfacing on each of the underlying flanks, defining hardfaced flanks;

wherein one of the hardfaced flanks has a thickness of the hardfacing that is greater proximate to the root and proximate to the crest than a central portion located between the root and crest, forming a generally scoop-shaped profile; and wherein the underlying flank of said one of hardfaced flanks is flat.

7. The earth-boring bit of claim 6 wherein the other of the hardfaced flanks has a thickness of the hardfacing that is greater proximate to a central portion located between the root and the crest than at the root and crest.

8. The earth-boring bit of claim 6 further comprising a generally flat recess milled in the surface of at least one of the underlying flanks between the root and the crest.

9. The earth boring bit of claim 6 wherein a centerline substantially bisecting each tooth between its flanks, and a radial line of the axis of rotation of the cone intersect at the crest at an angle.

10. An earth-boring bit comprising:

a bit body;

at least one roller cone rotatably mounted on the bit body;

a plurality of milled teeth at selected locations on the cone, wherein each tooth has leading and trailing underlying flanks converging from a root to define a crest;

wherein one of the underlying flanks of each tooth is generally concave from root to crest and the other of the underlying flanks of each tooth is flat; and a layer of substantially uniform hardfacing on each of the underlying flanks, defining hardfaced flanks.

11. The earth-boring bit of claim 10 wherein said one of the underlying flanks of each tooth that is generally concave from root to crest comprises a generally flat recess milled in the surface of said one underlying flank between the root and the crest.

* * * * *